United States Patent [19]

Galloway

[11] 4,007,750

[45] Feb. 15, 1977

[54] CONTINUOUS SHEET PICKLING APPARATUS

[75] Inventor: John W. Galloway, South Point, Ohio

[73] Assignee: Armco Steel Corporation, Middletown, Ohio

[22] Filed: July 14, 1975

[21] Appl. No.: 595,690

[52] U.S. Cl. ..... 134/83; 134/104; 134/133

[51] Int. Cl.[2] ..... B08B 3/04

[58] Field of Search ..... 134/64 R, 64 P, 83, 134/104, 122 R, 122 P, 133, 134, 165

[56] References Cited

UNITED STATES PATENTS

| | | | |
|---|---|---|---|
| 1,859,803 | 5/1932 | Shanafelt et al. | 134/64 R X |
| 3,032,890 | 5/1962 | Brick et al. | 134/122 X |
| 3,048,503 | 8/1962 | Foote et al. | 134/64 R X |
| 3,060,477 | 10/1962 | Wechsler | 134/133 X |
| 3,082,774 | 3/1963 | Benton et al. | 134/64 R X |

*Primary Examiner*—Robert L. Bleutge
*Attorney, Agent, or Firm*—Melville, Strasser, Foster & Hoffman

[57] ABSTRACT

A continuous sheet pickling line and apparatus therefor which embraces the concept of pickling sheets by passing them horizontally through a tank made of suitable material and so constructed as to hold a sufficient quantity of pickling acid as to permit the sheets to be completely submerged as they pass therethrough, certain of the support rollers for the sheets and drive gears and associated bearings also being submerged. The line and associated apparatus processes the sheets in one continuous operation during which the sheets are fed onto an entry conveyor from a pack, one sheet behind the other, whereafter they are processed while horizontally disposed through the pickling tank, sheet scrubber, drying conveyor, leveler, oiler and then stacked in a suitable piler. Provision is made to heat and agitate the acid within the tank and to control the acid level. Typically the sheets are conveyed through a tank 80 feet long on rolls fairly closely spaced, each roll being provided with a plurality of donuts, evenly spaced along the roll but staggered throughout the tank, thus providing the bottom side of the sheet with continuous exposure to the acid. Power to the rolls is supplied through a motor and conventional line shafting and right angle gear reducers, over the top of the tank and into a polypropylene gear arrangement.

16 Claims, 12 Drawing Figures

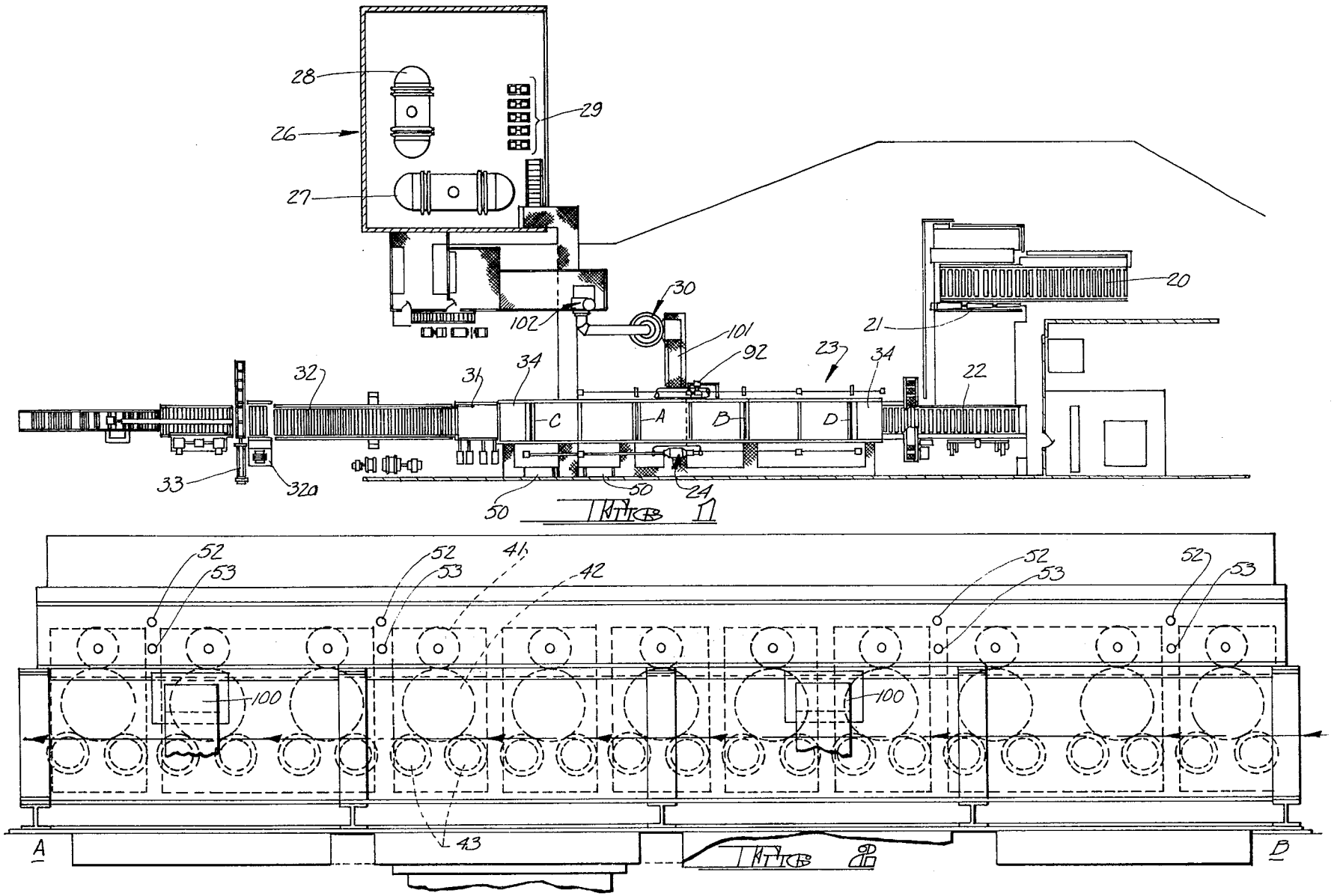
20
21
22
23
24
26
27
28
29
30
31
32
32a
33
34
50
52
53
100
101
102
92
41
42
43
A
B
C
D

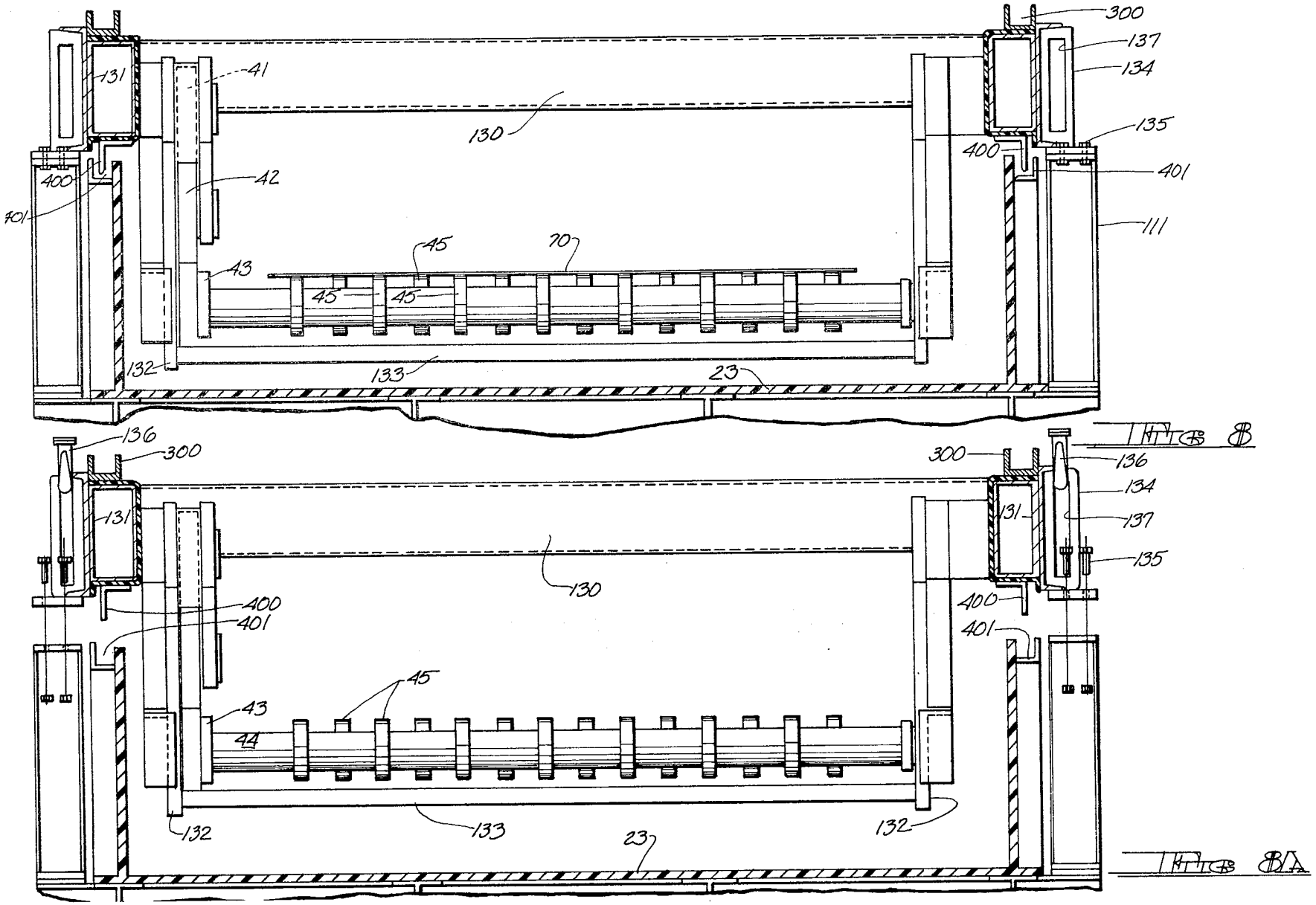
300
137
134
135
401
111
400
130
70
45
45
45
133
23
41
42
43
132
131
400
401
136
300
134
137
135
131
400
401
300
132
23
130
133
45
400
401
43
44
132
131
136
300

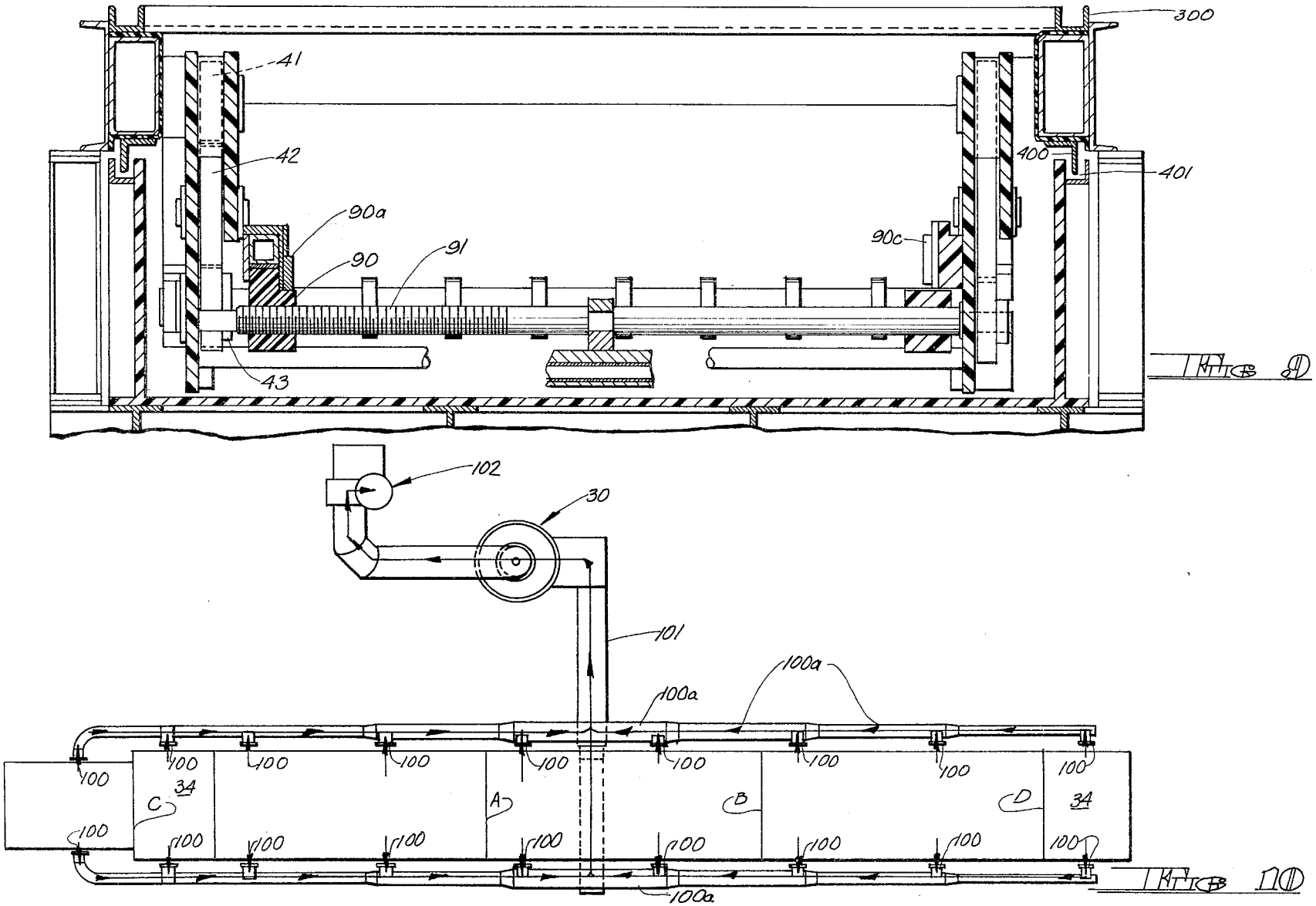
300
401
400
90c
91
90a
90
41
42
43
30
102
101
100a
100
34
A
B
C
D

CONTINUOUS SHEET PICKLING APPARATUS

BACKGROUND OF THE INVENTION

1. Field of the Invention

This invention has particular application to the pickling of steel sheets, sheets that are distinct cut lengths as opposed to coils of strip. The thicknesses of the sheets may range from 0.033 inch up to and including 0.500 inch. (In the heavier thicknesses, usually over about 0.250 inch, the cut lengths may be referred to as plates.) Pickling is defined as chemical removal of surface oxides and may be distinguished from removal of grease or dirt, that is, from a normal cleaning operation. (Material that has been oiled or greased, however, can be pickled with this invention, particularly if acid recovery is not important.) The oxides are formed during rolling on a hot strip mill. Sometimes the strip is sheared on the hot strip mill to cut lengths, or it may be sheared to cut length as a separate operation after rolling on the hot strip mill.

The sheet pickler may also be used to perform cleaning operations such as removing stain from sheets. This may be necessary where the hot strip mill coil is pickled on a strip pickle line and sheared into sheets, but the rinsing of the strip was done improperly so that it did not remove the acid stain. This invention, therefore, may also be used to pickle material that was not completely pickled on the strip picklers. This sheet pickler may also be used to remove rust spots from sheared sheets which have been held in inventory too long and have rusted.

Scale removal or pickling requires the most exposure time in the acid and is the determining factor in designing line speed and acid tank length once the acid concentration ranges and temperature range for operation have been selected.

2. Description of the Prior Art:

A search of this invention was conducted among the United States patents classified in the United States Patent Office. No ascertion is made that the closest prior art was developed by this search although that was indeed the intention thereof. Such search developed the following United States Patents Nos.: Buckman 451,264; Sague 493,560; Marsh et al. 1,392,780; Peacock 1,488,553; McSetroidge 1,679,435; Theiss 2,259,277; Theiss 2,259,278; Birkin 3,042,995; Laine 3,087,505; Maust 3,398,022 and Marshall et al. 3,451,452.

The search developed patents are of some interest. U.S. Patent No. 451,264 discloses cleaning horizonally disposed plates before they are coated. Patent No. 493,560 is similar, referring specifically to a pickling bath and disclosing further that certain rolls and the like are located within the vat, although these apparently are not driven rolls. Continuous circulation of a pickling solution is shown in U.S. Pat. No. 1,392,780. Patent No. 1,488,553 appears to show positively driven rollers submerged along with the horizontal sheet being treated. Patent 1,679,435 speaks of the prior art method of pickling sheets by submersing them in a hot pickle or acid bath, apparently while they are vertically disposed. U.S. Patents Nos. 2,259,277 and 2,259,278 disclose a pickling tank including feed rollers which are positively driven. U.S. Pat. No. 3,042,995 discloses the coating of steel pickling rollers with a plastic material. U.S. Pat. No. 3,087,505 discloses pickling apparatus for handling strips wherein certain of the rolls are submerged in the pickling bath. And U.S. Pat. No. 3,451,452 discloses the use of polypropylene plastic in controlling corrosion when HCL is used for pickling.

Typically, in the prior art the sheets were batch pickled in sulfuric acid while vertically disposed, and then processed further through the scrubber line which wetted and rinsed the surface of the sheets prior to oiling and piling. It was not unusual for such an operation to require 15 men a turn to operate. Such prior condition presented a safety hazard in that men had to reposition the sheets from the horizontal to the vertical and then vice versa. Sulfuric acid fumes were ever present in the pickling room. The sheets often contained pickle pin digs and scratches.

SUMMARY OF THE INVENTION

The pickling or scale removal operation of this invention treats cut lengths of sheet or plate while in the horizontal position. HCL acid is used. In order to expose the sheets or plates to this acid in a horizontal position for the times necessary for pickling, not only must the tank be of a suitable material to contain the acid but also the various roll bodies and shafts submerged in the acid must be resistant thereto. The speed range is from 30 feet per minute to 130 feet per minute with an acid tank length of 80 feet. The pickling time at these line speed ranges from 0.6 minutes to 2.67 minutes. In addition the rolls and related structure must be strong enough to bear the full weight of the sheets and plates, up to 2500 pounds.

In order to achieve the pickling rate indicated, agitation of the pickling bath is desirable. The bath temperature will be in the neighborhood of 180° F. with agitation and the equipment must withstand a 200° F. maximum temperature. The line herein discussed will pickle an average of five sheets per minute, or with respect to tons an average of 20 tons per hour. This has been accomplished with a reduction in manpower from 15 men per turn (the vertical batch, sulfuric acid arrangement) down to 3 (this invention).

The continuous sheet pickling line and apparatus therefor includes a tank made of polypropylene having a structural steel framework which supports the tank on the bottom and provides support to the tank along the sidewalls. The vertical supports on the sides of the tank contact it only when the temperature of the acid inside is elevated to about 180° F., pickling temperature. This vertical support is not continous, it is on approximately 5 feet 7½inches centers. Adjustable side guides may be employed to insure proper positioning of the sheets within the tank. These may be adjustable guides made of steel, encapsulated with polypropylene, utilizing granite blocks for a wear material. Heavier sheets may remain on center without side guide attention.

The sheets are supported on donut rolls in the pickle tank so as to expose the maximum amount of sheet surface to the acid bath and to eliminate the dams in the bath which would otherwise be created by the use of solid rolls. These donut rolls are staggered throughout the tank. Because of the indicated expanding and contracting nature of the polypropylene tank, it is desirable to provide an over the side drive arrangement wherein gearing is necessarily submerged in the HCL acid bath. These gears, therefore, are preferably constructed of polypropylene filled with fiberglass. In this regard polypropylene is the principal acid proof material used in the construction of the tank and components of the drive system. Steel or other suitable structural material encapsulated with polypropylene is used where required for strength.

Other features of the invention include the use of damming rolls to raise the liquid level of the tank 3 inches above the pass line or top of the donuts. A fume exhaust system for the pickling tank, which is covered, is provided. An acid recirculating pumping system for raising the acid level of the pickling tank above the pass line is arranged so that the acid is circulated via suitable piping through heat exchangers to deluge headers located in the pickling tank.

BRIEF DESCRIPTION OF THE DRAWINGS

FIG. 1 is a general schematic depiction of the HCL pickling operation comprising a continuous sheet pickling line and apparatus therefor.

FIG. 2 is a greatly enlarged side elevation of a portion of the pickling tank shown in FIG. 1; it is the center one of three tank units, this being the roll drive section.

FIG. 8 is a section through the pickling tank along a typical donut roll disposed therein.

FIG. 8a is an exploded view of the parts shown in FIG. 8 and illustrating the removable capabilities of the roll drive section.

FIG. 9 is a section taken on the line 9—9 of FIG. 3.

FIG. 10 is a plan view of the fume exhaust system schematically indicated in FIG. 1.

DESCRIPTION OF THE PREFERRED EMBODIMENTS

Figure 3:
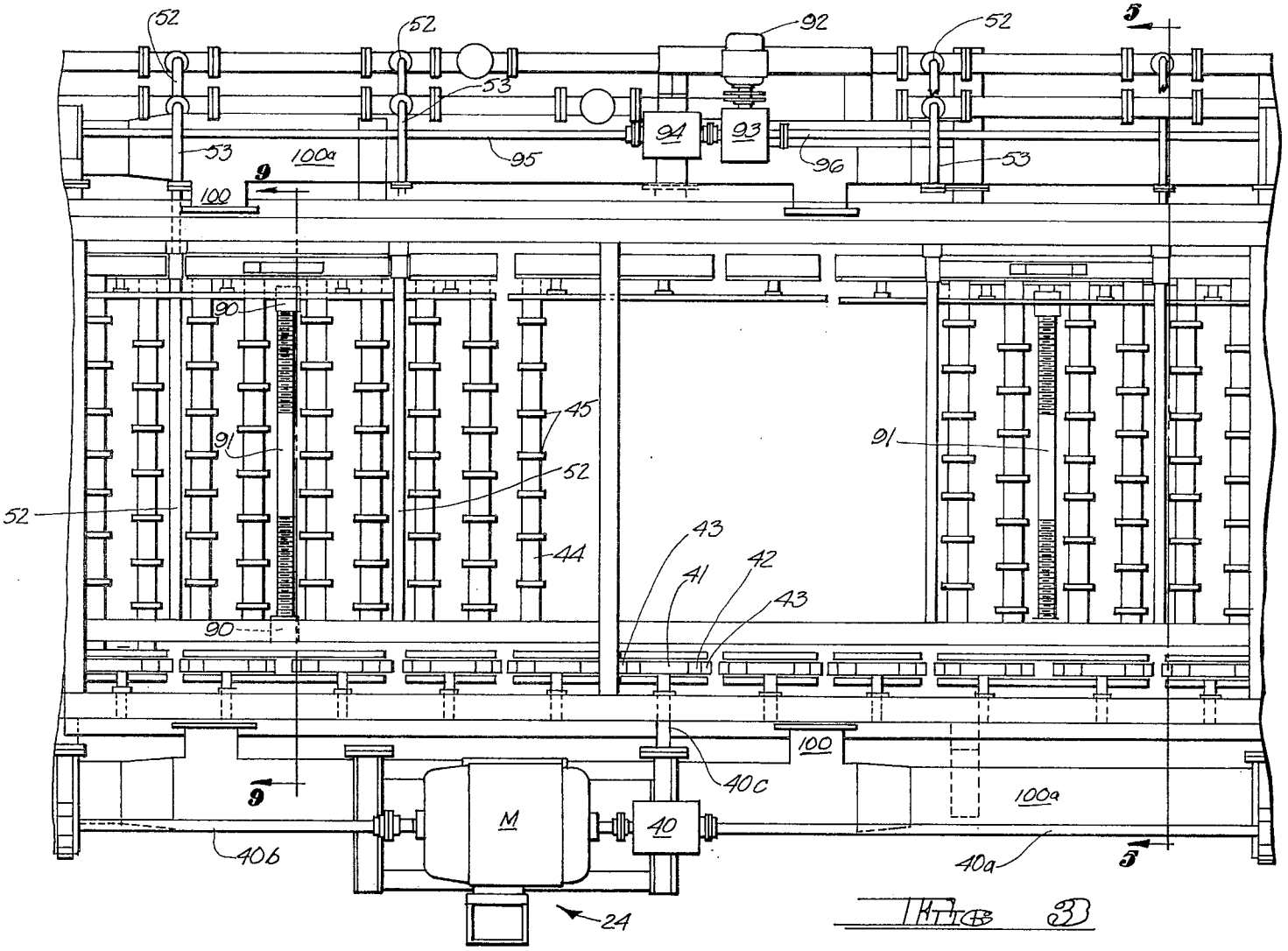
FIG. 3 is a plan view of the portion shown in FIG. 2, with the tank cover removed.

Referring first to FIG. 1, the continuous sheet pickle line is generally depicted as comprised of the following: A stocking conveyor 20 for receiving stacks of horizontally disposed sheets or plates from another line, storage or elsewhere; a transfer area which may employ a transfer car 21 or the like for effecting further movement of the stack; an entry conveyor 22 for delivering sheets or plates, one by one, one behind the other, to the pickling tank; a pickling tank generally indicated at 23; a donut drive roll system generally indicated at 24; removable tank covers 25 (see FIG. 4) extending over most of the pickling line; an acid recirculating system generally indicated at 26 and including a holding tank for HCL acid as shown at 27, an acid waste tank 28, suitable pumps 29 and appropriate piping to be described; a fume exhaust system generally indicated at 30; a sheet scrubber 31; a drying conveyor and printer 32; a leveler 32*a* (not shown in detail); an oiler or pinch roll 33; and a piler (not shown in detail).

The pickling tank 23 is shown as comprised of three sections which are: an end section lying approximately between the letters C and A indicated in FIG. 1, a center section lying approximately between the letters A and B, and another end section lying approximately between the letters B and D, also in FIG. 1. More or less of these sections may be employed depending on space and production requirements. A pair of weirs 34 are employed, one at each end of the pickling tank 23.

FIG. 2 is an enlarged side elevation of that portion of the pickling tank, the center portion (the roll drive section), which lies approximately between the letters A and B of FIG. 1. FIG. 3 is a plan view of a portion of this FIG. 2 with the cover 25 removed. These FIGS. 2 and 3 disclose the donut roll shaft drive, the fume system, the side guide drive, and the deluge headers in some detail. In these FIGS. 2 and 3 the donut roll shaft drive is shown as comprised of a motor M and a power takeoff 40 having a shaft 40*c* drivingly connected to an input gear 41 of a gearing scheme comprised of the input gear 41, an idler 42 and a pair of driven gears 43. Each of the gears 43 is on a donut roll shaft 44. The input gears 41 may be suitably connected together so that when one is driven, all are driven; this may be accomplished by suitable chains (not shown) and the like as will be understood by those skilled in the art. This arrangement is repeated throughout the tank.

As previously noted, FIGS. 2 and 3 depict the central portion of the tank as defined by the letters A and B of FIG. 1. The motor M and power takeoff 40 utilize conventional line shafting and right angle gear reducers which will be understood by those skilled in the art. This arrangement may also include a drive shaft 40*a* extending to one of the input gears 41 in the section B - D and a shaft 40*b* extending to an input gear 41 in the section C - A. The various input gears in the respective sections C-A, A-B and B-D will be operatively and drivingly connected to one another. In this manner all the donut roll shafts 44 throughout all sections of the pickling tank are driven via the motor M.

Each roll shaft 44 is provided with a plurality of donuts 45. In the arrangement indicated, the rolls or shafts 44 may be on one foot centers. Each roll shaft 44 is shown as provided with seven donuts evenly spaced across the rolls. The donuts 45 are staggered throughout the tank providing the bottom side of the sheet with continuous exposure to acid. As noted, power to the rolls 44 and donuts 45 is supplied from the motor M, which may be a 60 H.P motor through conventional line shafting and right angle gear reducers, over the top of the tank into the gear arrangement 41, 42 and 43. Since there is one driven gear 43 for each roll shaft 44, and since this type of drive arrangement is repeated throughout the pickling tank, all the rolls conveying the product are thus provided with power. The over the top of the tank and into the gear scheme is best seen in FIG. 4.

It is preferred that all wetted parts be polypropylene, reinforced with steel structural shapes. The gears 41, 42 and 43, and the roll shafts 44, are made in this manner. The bearings, generally indicated at 200 in FIG. 5, in which the roll shafts are seated, however, and which must also resist acid attack and at the same time provide free movement of the roll shafts, were found to work better when made of a pure carbon sleeve (the stationary part) with a 25% carbon in teflon rotating part. A sufficient clearance between the two bearing parts is needed since the expansion of the 25% carbon in teflon is greater at 180° F. than that of the pure carbon.

The spacing between roll shafts 44 must be less than the shortest sheets to be processed. This close spacing of rolls 44 would ordinarily interfere with the pickling of the bottom of the sheet through roll contact. The donut rolls 45, however, and the staggering thereof, minimize interference with pickling by the donuts which support the sheets or plates.

Figure 4:
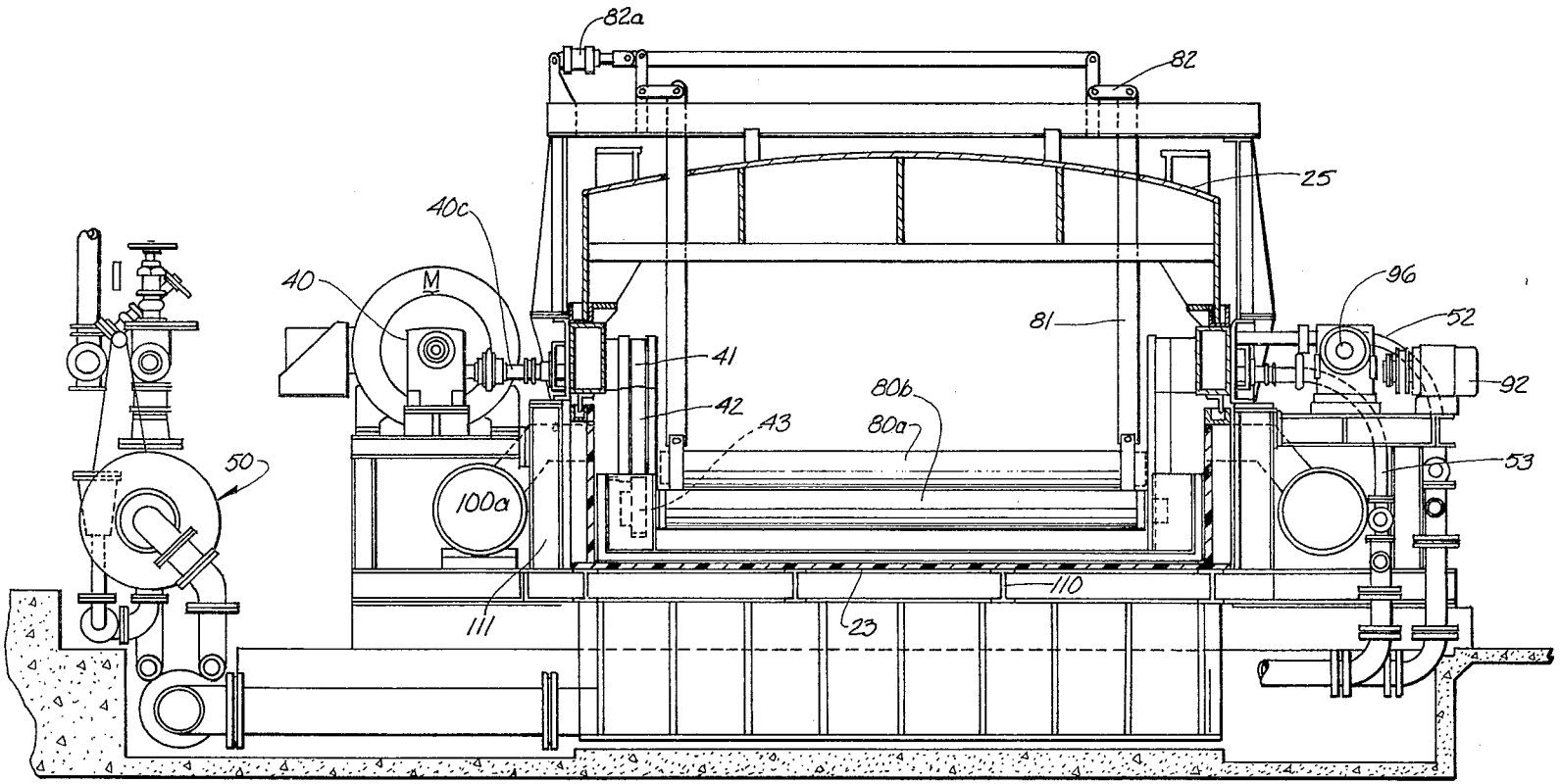
FIG. 4 is a composite sectional view taken through various of the principal components comprising the invention.

The over the top arrangement shown in FIG. 4 is desirable not only because of the expansion and contraction of the polypropylene pickling tank 23 but also because the gear scheme is largely within the acid bath and too much acid would spill out of the tank if the necessary shafting passed through the side walls of the tank. Modifications in this arrangement, however, are possible and, for example, it would be conceivable to employ an overhead pusher arm type conveyor (not shown).

Figures 5, 6, 7:
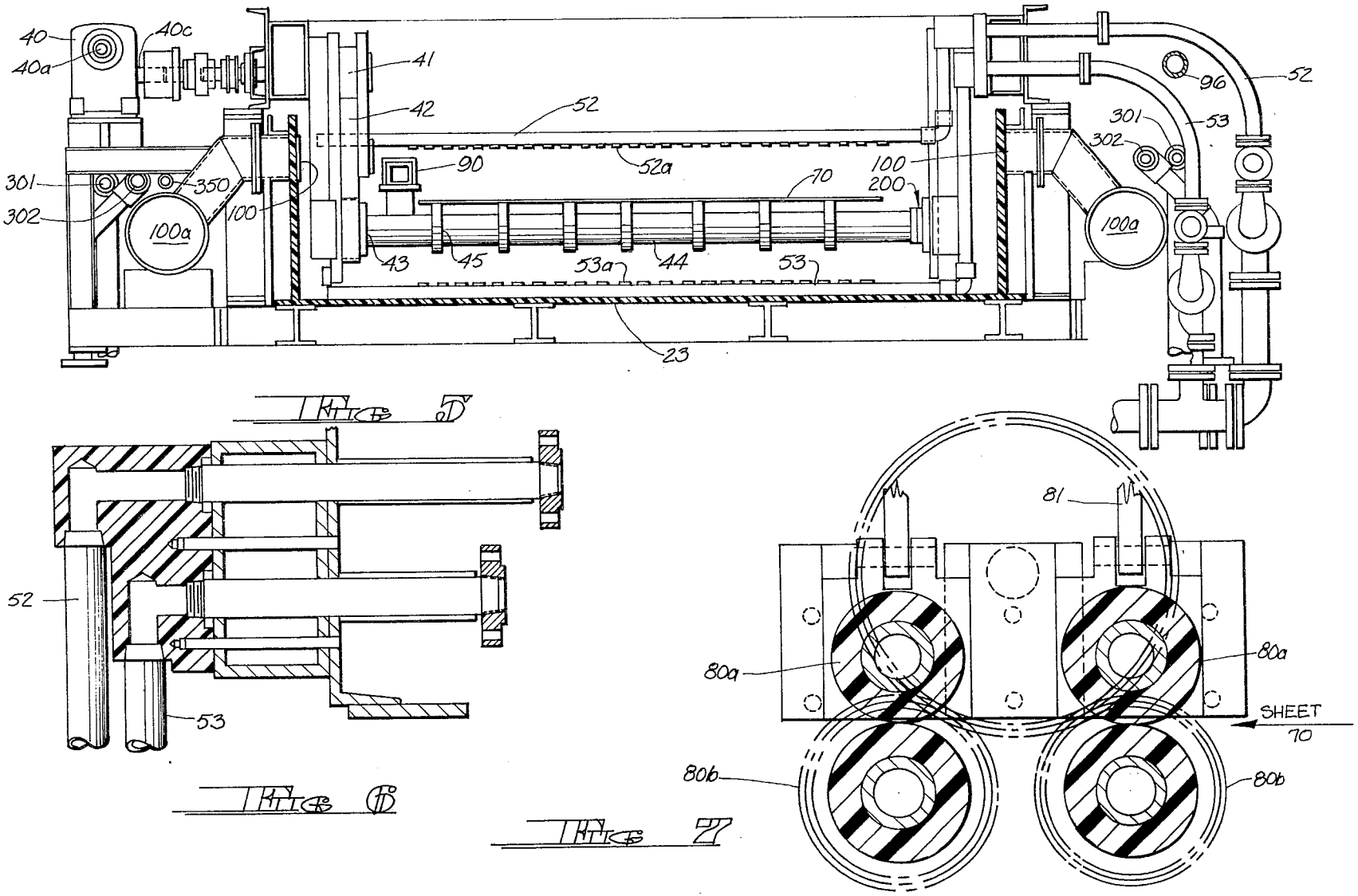
FIG. 5 is a section taken on the line 5—5 of FIG. 3.
FIG. 6 is an enlarged fragmentary detailed section of a portion ot the apparatus (piping for the deluge header system) shown at the upper right hand side of FIG. 5.
FIG. 7 is a fragmentary detailed section showing a portion of the damming roll arrangement employed within the ends of the tank.

As best seen in FIGS. 1, 5 and 6 acid is piped from heat exchangers 50 through appropriate piping to an upper deluge header system 52 and to a lower deluge header system 53. The sprays 52*a* (which may simply be apertures bored into appropriate pipes) of the upper deluge headers are turned to discharge acid toward the discharge end of the unit. This aids in keeping light gauge plates from cocking as they pass through the pickling tank 23. The sprays 53*a* from the bottom deluge headers, which are located in the bath along the floor of the tank, discharge acid straight up between donut rolls 45. A plurality of these upper and lower deluge headers 52 and 53 extend throughout the central section of the pickling tank as shown in FIG. 2.

Figure 11:
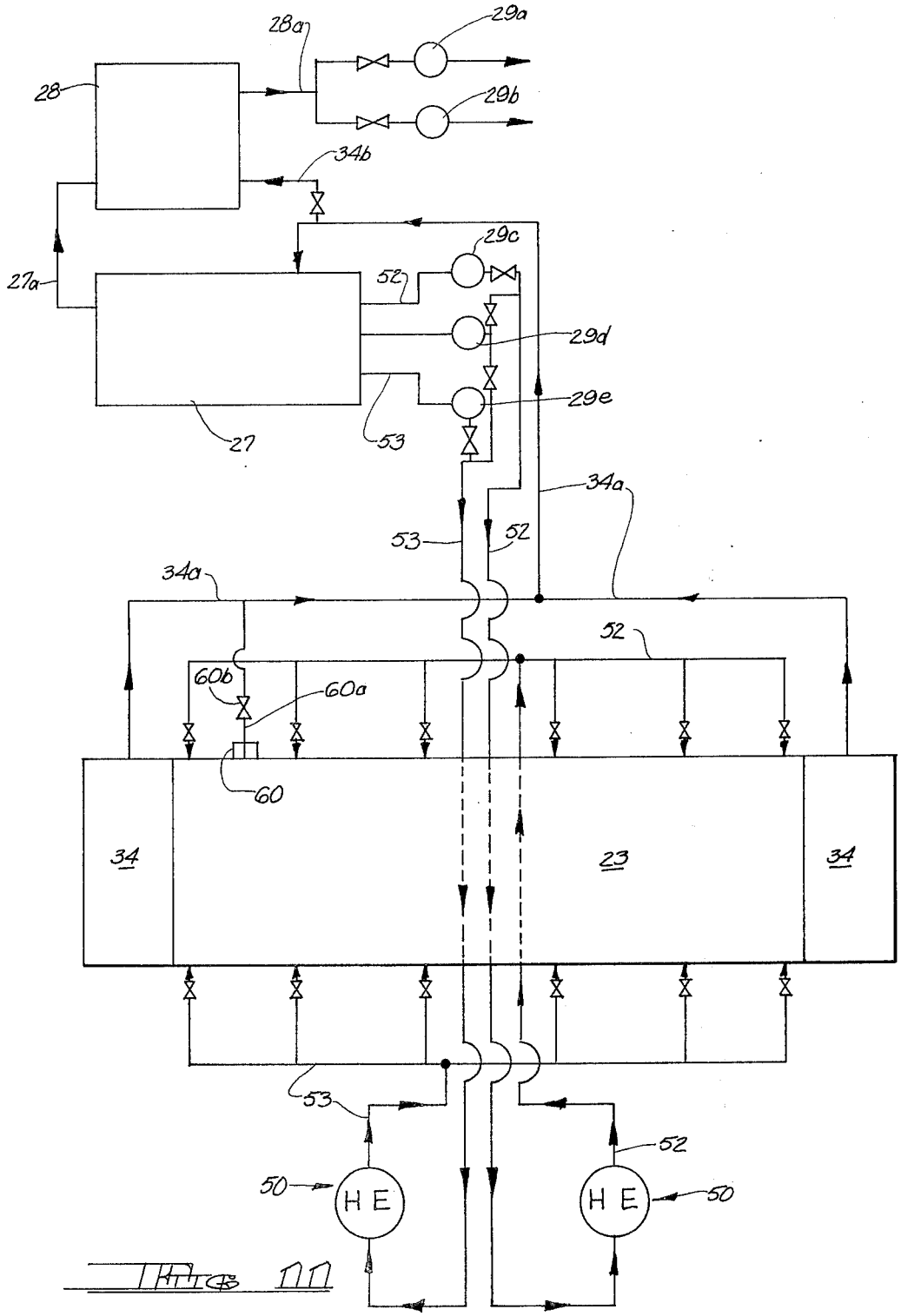
FIG. 11 is a schematic depiction of the acid flow utilized in the invention.

In FIG. 11 the HCL acid system is further illustrated. The holding tank 27 is provided with HCL acid from a suitable source (not shown) and has an overflow connection 27*a* to the waste tank 28. Two of the pumps 29 are connected to this waste tank 28 as indicated at 28*a* and are designed to remove waste acid to some suitable area; normally one pump functions to do this while the other acts as a spare. The other three pumps 29 are connected to the holding tank 27 and act to pump acid through the heat exchanger 50 via the upper and lower deluge header systems 52 and 53; two of these latter three pumps are operative while the remaining is held in reserve. Excess acid which collects in the weirs 34 flows by gravity through appropriate lines 34*a* back to the tank 27. A bleed line 34*b* and appropriate valve permit a portion of the acid to be diverted to the waste tank 28. The bottom of the tank 23 is provided with a drain 60 and line 60*a* to the overflow weir line 34*a* via the valve 60*b*. Thus when it is desired to empty the tank 23 this may conveniently be done manually simply by opening the valve 60*b*.

It will be understood that the pumps 29 are of proper capacity, and the tank 27 likewise, as to enable the pickling tank 23 to contain sufficient acid that it will extend to a level approximately 3 inches or so above the top surface of the sheet or plate 70 which is passed through the tank during the pickling operation. Excess acid will collect in the end weirs 34 as indicated. The entrance to the pickling tank section B –D and the exit of the pickling tank section A - C are provided with damming rolls 80. The arrangement is best seen in FIG. 7. There are pairs of upper and lower rolls 80*a* and 80*b* one pair being spaced adjacent the entrance, for example, and the other pair being spaced inwardly therefrom. Four similar damming rolls 80*a* and 80*b* will be provided at the exit end of the pickling tank 23. All of the lower damming rolls 80*b* may be driven via the same drive system which drives the donut roll shafts 44. The upper rolls 80*a* need not be driven and are supported from means 81 and 82 (see FIGS. 4 and 7) which permit them to be moved upwardly as the plate 70 enters the bite between damming rolls 80*a* and 80*b*. This may also be accomplished by use of power (82*a*).

As a plate 70 enters the pickling tank 23 from the right as viewed in FIG. 7 the right hand upper damming roll 80*a* will move vertically and some acid will escape into a weir 34. The presence of the left hand pair of damming rolls 80*a* and 80*b* however, minimizes the amount of acid that will so escape. Then after the trailing edge of the plate 70 passes through the bite of the right hand pair of damming rolls 80*a* and 80*b*, the upper roll 80*a* of this pair will fall by gravity to the position illustrated wherein it and the lower roll 80*b* will minimize the escape of acid through the entrance slot provided in the wall of the pickling tank 23 for passage of the plate 70. When this trailing edge also passes through the left hand pair of damming rolls shown in FIG. 7 further damming will be accomplished. As indicated, a similar arrangement is provided at the exit end of the pickling tank and it operates in the same manner. These damming rolls 80 may be of rubber or a suitable material resistant to corrosion by HCL acid.

As shown in FIGS. 3 and 5 moveable side guides 90 may be provided to assist in keeping the plates 70 properly centered on the donuts 45. These may be located at intervals along the pickling tank and may be mounted on screws 91 which may be threaded at both ends, in reverse directions, if guides 90 are to be utilized at both sides of the tank as indicated in FIG. 3. As indicated in FIG. 5, however, it is possible that these movable guides 90 need be located only along one side of the tank. Drive means for the screws 91 are generally indicated at 92, some of the driving connections 93, 94, 95 and 96 between the side guide drive 92 and screw shafts 91 not being shown in detail but being readily understood by those skilled in the art to be of conventional nature. This side guide drive system 91–96 is generally similar to that indicated at M and 40, 40*a*, 40*b* and 40*c* for driving the roll shafts 44 and the donuts 45.

Further details of the side guide arrangement are shown in FIG. 9. This FIGURE discloses the use of a moveable side guide 90 having a granite face 90*a* against which plates 70 riding on donuts 45 may abut. In this FIGURE there is shown a moveable side guide 90 at one side of the pickling tank 23 and a fixed side guide 90*c* at the opposite side thereof. The side guide drive screw is again designated by the reference numeral 91, in this instance, however, there being threads at only one end thereof.

Means are also provided to remove acid fumes to exhaust. In FIGS. 2 and 5 suitable fume intake means 100 and associated conduits are shown as located above the surface of the acid bath. The intake is connected to a fume exhaust 101. Fumes entering through intakes 100 and passing through the fume exhaust conduits 101 and associated blower mechanism 102 eventually pass through these conduits (see FIG. 1) and into scrubber 30 whereafter the cleaned air may be exhausted from the building by way of a stack.

Additional details of the fume exhaust system are shown in FIG. 10. A blower 102 will draw fumes from within the covered pickling tank 23 via the intakes 100 located along opposite sides of the pickling tank 23, through the stepped conduit system 100*a* and eventually into the fume exhaust conduit 101 extending beneath the pickling tank 23 and into the scrubber 30. As shown in FIG. 8, further acid fume control is achieved by providing channels 300 which are kept supplied with water via supply and return conduits 301 and 302 (FIG. 5) and into which channels the lower rim of the cover 25 will be received. (Conduit 350 of FIG. 5 is simply an air line for maintenance use.)

As best seen in FIG. 4 the polypropylene pickling tank 23 is arranged to be supported on steel frame members 110 beneath the bottom thereof. Vertical steel frame members 111 are spaced from the outer side walls of the tank 23 along the length thereof and are adapted to confine and support the tank when it expands due to the heated, agitated acid which is pumped thereinto.

A further depiction of the arrangement by which the steel, encapsulated with polypropylene, gear arrangement is directed over the top of the side walls of the tank 23 is shown in FIGS. 5, 8 and 9. The shaft 40*c* from the power takeoff 40 drives the upper, input gears 41. Each of these drives an idler gear 42. Each idler gear 42 drives two driven gears 43 and each of these driven gears 43 is fixed on a roll shaft 44 on which are mounted the donuts 45 on which the plate or sheet 70 is disposed as it passes through the pickling tank 23. All of these gears are subjected either to the acid itself or to acid fumes.

FIGS. 8 and 8A disclose another feature of this invention by which cleaning of the apparatus is simplified. The frame structure 130, 131, 132, 133 and 134 may be bolted to certain ones of the exterior vertical frame supports 111 as indicated at 135. The various components of the pickling tank, such as the over the side gears 41–43 and the roll shafts 44 and donuts 45, are all mounted in this frame structure. By removing the bolts 135 as indicated in FIG. 8*a*, crane hooks 136 may be engaged within the slots 137 of the frame members 134 and the unit removed from the pickling tank 23. Prior to this, of course, the shaft 40*c* from the power takeoff 40 will have been disengaged from the gear train 41–43. Additionally the side guide input shaft, if used, will have been similarly disconnected, and the deluge header system pipe connections (six upper and six lower) will also have been disconnected. The tank 23 may or may not be emptied at this time, as desired. In this manner all of the tank components are made readily available for cleaning and repair.

These FIGS. 8 and 8A also depict additional means for enhancing fume control. To this end the upper frame structure 130–134 is provided with a depending flange 400 which extends into a trough 401 kept filled with water via the conduits 301 and 302 earlier mentioned. This arrangement, coupled with the like water seal effected at 300 for the cover 25, insures that the fume exhaust system 100–102 of FIG. 10 will work most efficiently.

With respect to the recirculating pumping system for raising the acid level of the pickling tank 3 inches above the pass line, the following data is relevant. The three pumps 29*c*, 29*d* and 29*e* (FIG. 11), by way of example, may be 500 G.P.M. recirculating pumps; as noted earlier 29*c* will be connected to the upper deluge header system 52 while the pump 29*e* will be connected to the lower deluge header system 53, the pump 29*d* being held as a spare. The holding or recirculating tank 27 may be of 8,000 gallon capacity. The heat exchangers 50 may be of the carbon block type. Acid strainers (not shown) will normally be placed between the holding tank 27 and pumps 29*c* through 29*e*, and between waste tank 28 and pumps 29*a* and 29*b*, so that all these pumps receive cleaned material sucked from the tanks.

The system will, of course, employ the necessary valves as generally indicated in FIG. 11 and it is contemplated that the piping be constructed of fiberglass. As also depicted in FIG. 11 it is contemplated that there will be twelve acid deluge header components, six above the plate and bath, and six in the bath beneath the bottom side of the sheet. These headers will have the spray apertures 52*a* (top) and 53*a* (bottom) as depicted in FIG. 5. Preferably these specific spray arrangements are located in the central section of the pickling tank as depicted in FIG. 2.

The recirculating system pumps 29*c* and 29*e* circulate the acid in tank 27 through the heat exchangers 50 and the deluge headers 52 and 53 which are located in the pickling tank as just described. The acid enters the pickling tank, raising the level, agitating the bath and replenishing the solution with heat and acid. Agitating, replenishing and heat are the key ingredients to good pickling with HCL. The damming roll setups 80*a* and 80*b*, there being two such units at each end of the pickling tank 23, retain the acid sufficient to raise the level about 3 inches above the top of the plate 70. Excess acid escapes over, around and through damming roll assemblies into the weir tanks 34 and, from here, through pipes by gravity back to the recirculating tank. This tank is the reservoir for the pumps to take suction from, plus fresh acid to be added to the system from time to time from a source not shown.

SUMMARY OF OPERATION

The invention is accomplished by an apparatus which conveys steel sheets of varying thicknesses, widths and lengths, lying flat in a horizontal position on donut conveyor rolls 45 through and immersed in a HCL acid bath contained in a steel reinforced polypropylene tank 23. This is to be distinguished from the prior art which accomplished pickling by stacking the sheets in a vertical position upon narrow racks which were then dipped into a sulfuric acid bath.

The apparatus of this invention includes the stocking conveyor 20, transfer area and car 21, entry conveyor 22, pickling tank 23, donut roll drive system 44, 45 as accomplished through a gear system extending over the top of the side walls of the tank 23, and including a series of input gears each driving an idler gear which in turn drives a pair of driven gears fastened to the roll shafts 44. The apparatus also includes the pickling tank cover arrangement 25, the acid recirculation system, and the fume exhaust system in cooperation with the pickling tank. This latter arrangement faciliates unusually effective fume control of the sheet pickling apparatus and is an important part of the system.

The pickling tank, by way of example, is illustrated as being 80 feet long and is so designed that all wetted parts are polypropylene (or some equivalent substance), reinforced with steel structural shapes and/or tubing. The rolls for conveying the sheets, the associated gears and drive system and tank covers, all of which are exposed to the acid bath or fumes, are of the same type construction as the tank.

The drive system is unique in that driven rolls are immersed in HCL acid and remain continuously below acid level. Preferably the rolls or shafts 44 are each provided with seven donuts 45, evenly spaced across the roll; these donuts, which contact the sheet, are staggered from roll to roll so that the bottom side of the sheet is continuously exposed to the acid bath.

Immersion of the steel sheets or plates in the acid, and movement of them by the roll system through the HCL bath, provide pickling of the sheets and plates that has not heretofore been accomplished by prior art methods.

Other advantages of the apparatus, in addition to the clean, bright, stain free appearance after pickling, are: (1) the elimination of pickled pin digs and scratches, (2) a reduction in manpower from 15 men/turn to 3 men/turn to accomplish the same production, (3) improved safety conditions due to less handling of the sheets by the men and (4) virtual elimination of acid fumes in the working area. (Pickled pin digs and scratches occurred in prior processes due to the vertical stacking of sheets and insertion of metal pins between the sheets to provide a gap where acid could flow.)

It will be apparent to those skilled in the art that modifications may be made in this invention without departing from the scope and spirit thereof. It should also be understood that while the invention has been described in terms of certain structures and arrangements, the invention is not to be limited to these certain structures and arrangements except insofar as they are specifically set forth in the subjoined claims.

The embodiments of the invention in which an exclusive property or privilege is claimed are defined as follows:

1. A continuous sheet pickling line and apparatus therefor which comprises: a pickling tank adapted to contain a bath of pickling acid, said tank being comprised of an acid resisting, steel supported material having expansion characteristics differing from that of the steel; a plurality of horizontally disposed, parallel roll shafts disposed in said tank; a plurality of sheet bearing donuts mounted on each of said shafts; means to drive at least some of said shafts; the said means to drive said shafts including submerged shaft bearings and a gear train located within said tank; a drive shaft extending over said tank to said gear train; power means located outside of said tank and connected to said drive shaft; means to maintain a level of bath acid which is above that of the sheets passing therethrough on said donuts; and means to introduce sheets into said tank and onto said donuts.

2. The pickling line of claim 1 including a cover for said tank and fume exhaust means located between said tank and said cover.

3. The pickling line of claim 1 including side guide means to insure that sheets are disposed on said donuts so that said roll shafts extend across the line of travel of the sheets through the tank.

4. The pickling line of claim 1 in which the means to maintain the level of bath acid above the top of the sheets passing through the tank comprise a pair of upper and lower damming rolls extending across and within the tank at the entrance end thereof and normally disposed closer to one another than the thickness of a sheet passing through the tank, said tank having an entrance aperture to permit a sheet to be fed therethrough into the bite of said rolls, and means to insure that said rolls will part sufficient to permit said sheet to just nicely pass therebetween and to thereafter return to their normal position.

5. The pickling line of claim 4 including a similar pair of damming rolls at the exit end of said tank, said tank having an exit aperture to permit a sheet to pass therefrom after passing through the bite of said similar pair of rolls.

6. The pickling line of claim 5 including two additional pairs of damming rolls, one of said additional pairs being located adjacent said first mentioned pair of rolls and inwardly of said tank and the other of said additional pairs being located adjacent said second mentioned pair of rolls and inwardly of said tank, the bites of all of said pairs of rolls being parallel.

7. The pickling line of claim 1 including means to recirculate the bath acid within said tank, means to heat said acid before it enters said tank, and means to agitate said acid within said tank.

8. The pickling line of claim 7 in which said agitating means comprises upper and lower headers, above and below the sheet passing through the tank, and spray means on said headers directed to the upper and lower sides of the sheet.

9. The pickling line of claim 8 in which the spray means on said upper header direct the acid towards the sheet and in the direction of sheet travel through the tank, and the spray means on said lower header direct the acid upwardly through the bath acid, between the donuts and towards the bottom of the sheet.

10. In a continuous sheet pickling line, a pickling tank comprising: a bottom, a pair of side walls, and a pair of end walls, said end walls each having an aperture therein to just nicely permit a sheet to be pickled to pass therethrough while horizontally disposed, said apertures being aligned, and said tank being adapted to contain a bath of HCL acid, the said bottom and said side walls and said end walls being comprised of an acid resisting, steel supported material having expansion characteristics differing from that of the steel; means to maintain the level of said acid above said apertures, said last mentioned means including an acid recirculating system and damming elements adjacent said apertures; roll shafts and shaft bearings disposed in said bath and donut rolls on said shafts, said donut rolls being adapted to receive and support sheets passed through said apertures, sheets on said donut rolls being beneath the surface of said acid; means to pass sheets through said apertures onto said donut rolls; and means to drive said roll shafts so as to move said sheets through said tank from one said aperture to the other said aperture, the said means to drive said roll shafts including a motor and a power take-off located outside of said tank, and a gear train in said tank extending into said bath and connected to said roll shafts, and a driving connection from said power take-off to said gear train, said driving connection extending over a said side wall.

11. The pickling tank of claim 10 including a cover for said tank; and fume control means for collecting fumes from within said covered tank.

12. The pickling tank of claim 10 in which said acid recirculation system includes means to heat said acid, and means to agitate said acid.

13. The pickling tank of claim 12 in which the said means to agitate said acid includes at least one deluge header above said sheets and at least one deluge header in said bath below said sheets.

14. The pickling line of claim 10 in which the said acid resisting, steel supported material is polypropylene, and said gear train is also comprised of polypropylene.

15. The pickling tank of claim 10 in which said gear train includes an input gear driven by said driving connection, an idler gear driven by said input gear, and a pair of drive gears driven by said idler gear, each of said drive gears being connected to a different one of said roll shafts.

16. The pickling tank of claim 10 in which a said damming element comprises at least one pair of upper and lower rolls within said tank adjacent a said aperture, said rolls normally being disposed adjacent one another so as to present a bite opposite said aperture, and means to permit said rolls to separate when a sheet is passed through said aperture into and through said bite and onto said donut rolls.

* * * * *